United States Patent [19]

Dewing et al.

[11] 4,213,599

[45] Jul. 22, 1980

[54] APPARATUS FOR THE PRODUCTION OF ALUMINIUM

[75] Inventors: Ernest W. Dewing, Arvida; Jean-Paul R. Huni, Kingston; Raman R. Sood, Arvida; Frederick W. Southam, Kingston, all of Canada

[73] Assignee: Alcan Research and Development Limited, Montreal, Canada

[21] Appl. No.: 909,987

[22] Filed: May 26, 1978

Related U.S. Application Data

[62] Division of Ser. No. 799,762, May 23, 1977, Pat. No. 4,099,959.

[30] Foreign Application Priority Data

May 28, 1976 [GB] United Kingdom ..... 22474/76

[51] Int. Cl.[2] ..... F27B 3/08

[52] U.S. Cl. ..... 266/166; 266/171; 266/215; 13/23

[58] Field of Search ..... 266/171, 166, 215; 13/23

[56] References Cited

U.S. PATENT DOCUMENTS

| | | | |
|---|---|---|---|
| 746,796 | 12/1903 | Danckwardt | 75/66 |
| 1,313,274 | 8/1919 | DeBarros | 75/10 R |
| 2,612,444 | 9/1952 | Rummel | 266/171 |
| 3,230,072 | 1/1966 | Johnson | 75/10 |
| 3,823,014 | 7/1974 | Chong | 75/66 |
| 3,971,653 | 7/1976 | Cochran | 75/10 R |

*Primary Examiner*—M. J. Andrews

*Attorney, Agent, or Firm*—Cooper, Dunham, Clark, Griffin & Moran

[57] ABSTRACT

In a apparatus for the production of aluminium a molten alumina slag, containing combined carbon is circulated through one or more alternately arranged relatively low temperature zones where carbon is added to increase the combined carbon content of the slag by reaction with the alumina slag and high temperature zones where aluminium metal is released by reaction of aluminium carbide and alumina in the slag with consequent depletion of the combined carbon content. Alumina is supplied to the slag at one or more locations. The energy to drive the reactions is preferably supplied by resistance heating of the slag particularly in transit from a low temperature zone to a high temperature zone although usually additional energy is supplied to the slag in the return from a high temperature zone to the next low temperature zone.

In most instances the aluminium-liberating reaction is carried out in an upwardly inclined passage and the gas evolved is employed to achieve the circulatory movement of the slag. It is a preferred feature to scrub the gas with carbon without admixed alumina to avoid formation of sticky aluminium oxycarbide in the carbon, which is subsequently added as process charge.

18 Claims, 20 Drawing Figures

Figure 1:
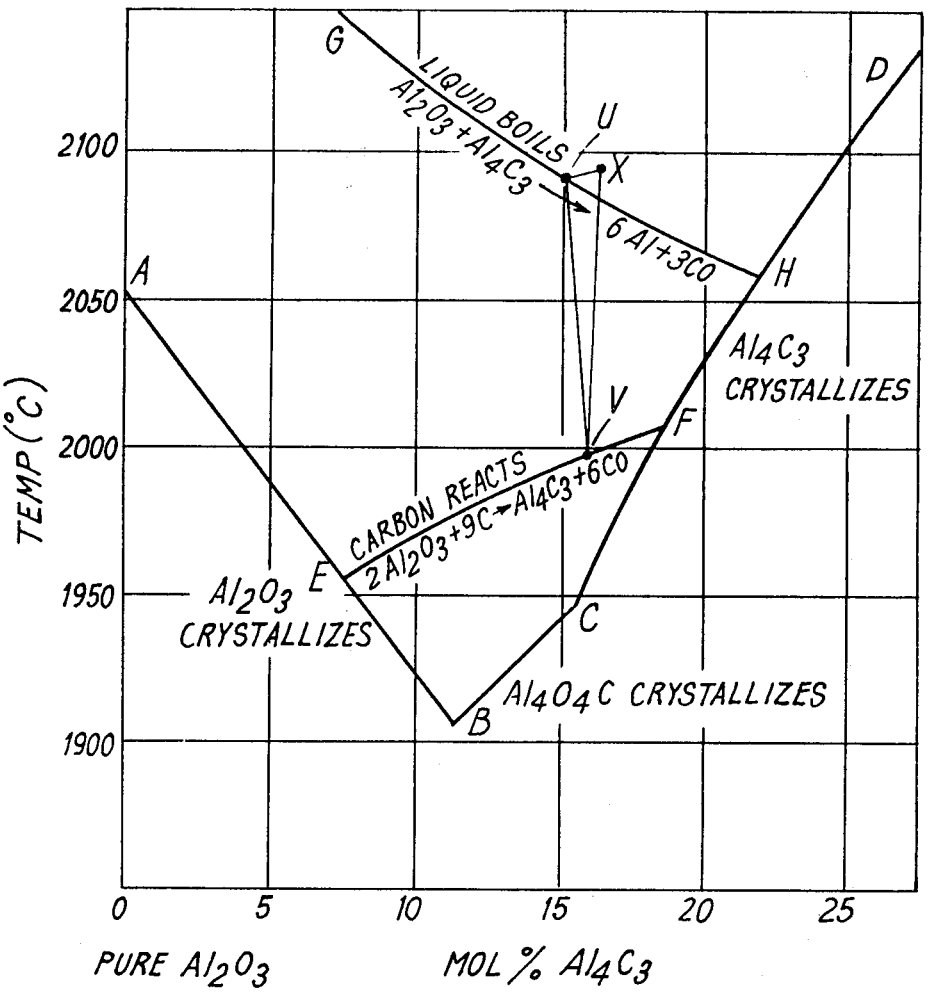

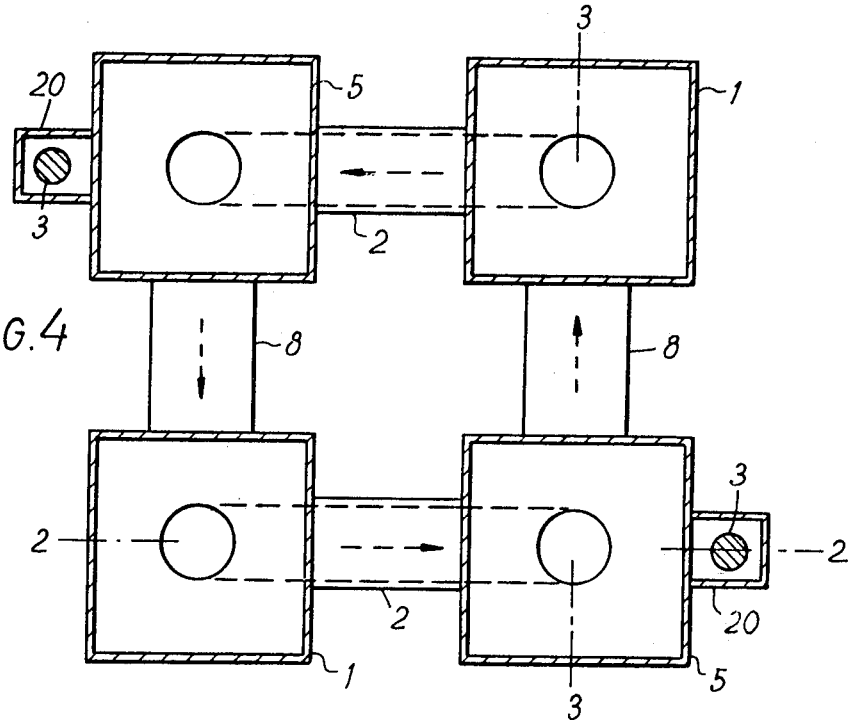
FIG. 4
FIG. 6
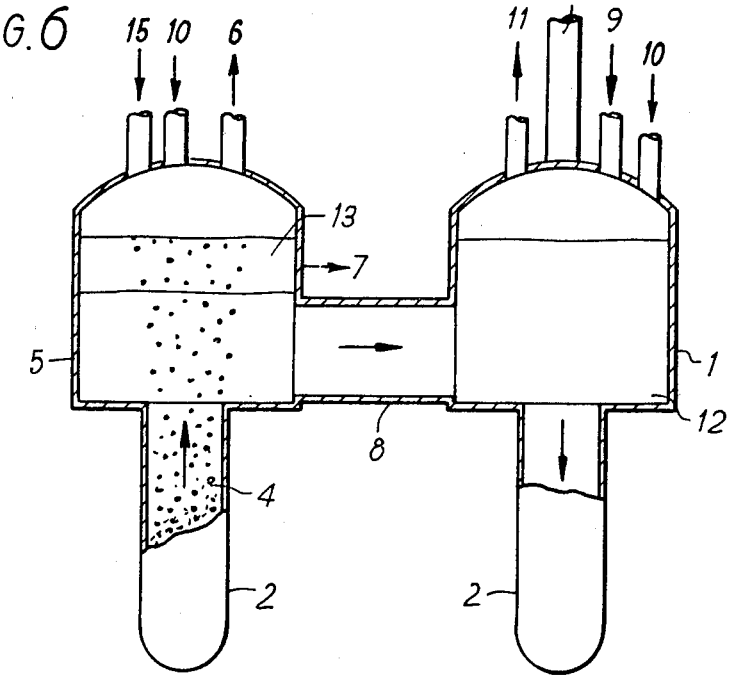

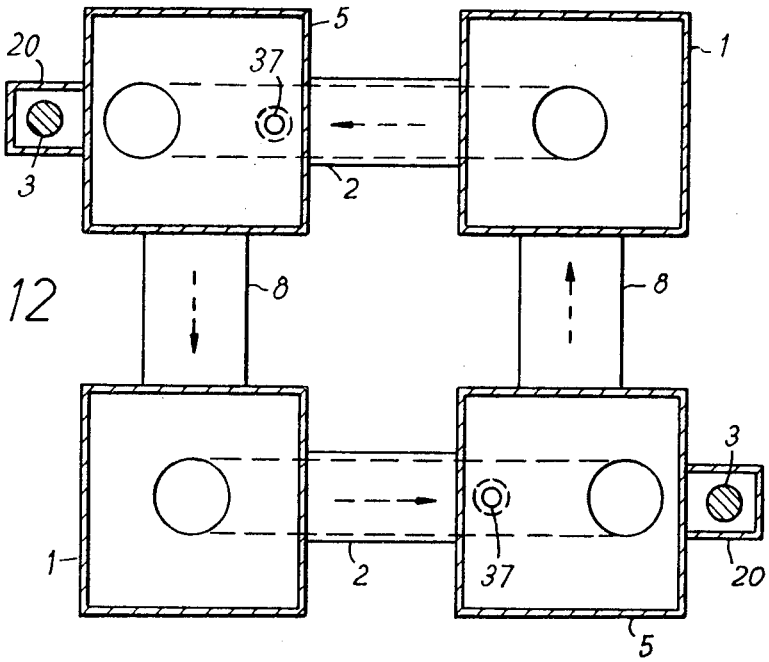
FIG. 12
FIG. 13
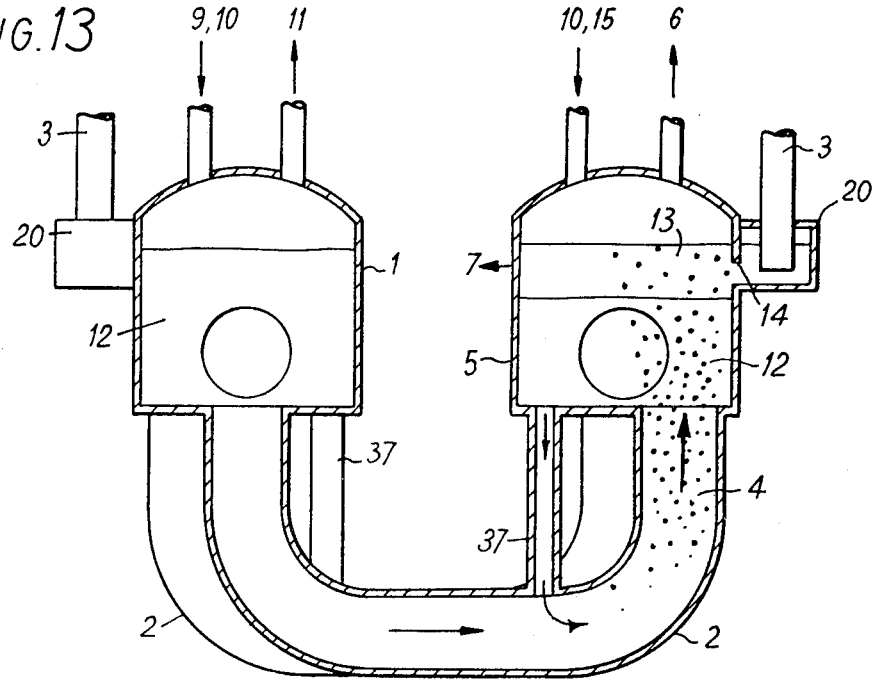

APPARATUS FOR THE PRODUCTION OF ALUMINIUM

This is a division of application Ser. No. 799,762, filed May 23, 1977 now U.S. Pat. No. 4,099,959.

The present invention relates to the production of aluminium by the direct reduction of alumina by carbon.

The direct carbothermic reduction of alumina has been described in the U.S. Pat. Nos. 2,829,961 and 2,974,032, and furthermore the scientific principles involved in the chemistry and thermodynamics of the process are very well understood (P.T. Stroup, Trans. Met. Soc. AIME, 230, 356–72 (1974), W. L. Worrell, Can. Met. Quarterly, 4, 87–95 (1965), C. N. Cochran, Metal-Slag-Gas Reactions and Processes, 299–316 (1975), and other references cited therein). Nonetheless, no commercial process based on these principles has ever been established, due, in large part, to difficulties in introducing the necessary heat into the reaction and in handling the extremely hot gas, containing large quantities of aluminium values, which is produced in the reaction. For example, the process of U.S. Pat. No. 2,974,032, requires heating the reaction mixture from above with an open arc from carbon electrodes; excessive local overheating is inevitable, increasing the severity of the fuming problem, and at the same time open arcs are electrically of low efficiency and the carbon electrodes are exposed to a very aggressive environment.

It has long been recognised (U.S. Pat. No. 2,829,961) that the overall reaction $$Al_2O_3+3C=2Al+3CO \quad \text{(i)}$$

takes place, or can be made to take place, in two steps:

$$2Al_2O_3+9C=Al_4C_3+6CO \quad \text{(ii)}$$

and $$Al_4C_3+Al_2O_3=6Al+3CO \quad \text{(iii)}$$

Due to the lower temperature and lower thermodynamic activity of aluminium at which reaction (ii) may take place, the concentration of fume (in the form of gaseous Al and gaseous $Al_2O$) carried off by the gas from reaction (ii) when carried out at a temperature appropriate to that reaction is much lower than that carried in the gas at a temperature appropriate to reaction (iii); furthermore, the volume of CO from reaction (iii) is only half that from reaction (ii).

Both the reaction steps noted above are endothermic and existing data suggests that the energy required for each of the two stages is of the same order of magnitude.

The present invention relies on establishing a circulating stream of molten alumina slag, containing combined carbon, in the form of aluminium carbide or oxycarbide, circulating the stream of molten alumina slag through a low temperature zone (maintained at least in part at a temperature at or above that required for reaction (ii), but below that required for reaction (iii)), forwarding the stream of molten alumina to a high temperature zone (maintained at least in part at a temperature at or above a temperature required for reaction (iii)), collecting and removing aluminium metal liberated at said high temperature zone, returning the molten alumina slag from the high temperature zone to the same or subsequent low temperature zone, introducing carbon to the circulating stream of molten alumina slag in said low temperature zone and introducing alumina to the circulating stream. The introduction of alumina to the circulating stream may be effected at the same or at a different location from the introduction of carbon. It will be understood that the molten slag may circulate through one low temperature zone and one high temperature zone or circulate through a system comprising a series of alternately arranged low temperature zones and high temperature zones. Even where there is a series of alternately arranged low temperature zones and high temperature zones, it is possible to introduce alumina at a single location.

While it is possible to perform the process of the invention in such a manner that molten alumina slag is circulated between low and high temperature zones in the same vessel, it is generally preferred that these zones are maintained in different vessels so that the carbon monoxide evolved in reaction (iii) may be led off separately from that evolved in reaction (ii), thus reducing the loss of gaseous aluminium and aluminium suboxide.

The product aluminium and at least a major part of the gas evolved in reaction (iii) are preferably separated from the molten slag by gravitational action by allowing them to rise through the molten slag in the high temperature zone so that the product aluminium collects as a supernatant layer on the slag and the evolved gas blows off to a gas exit passage leading to apparatus for fume removal.

The requirements for introduction of heat energy into the system are three-fold (a) to support reaction (ii), (b) to support reaction (iii), and (c) to make up heat losses. The heat requirement (c) may be provided by the sensible heat of the slag as it enters the low temperature zone. If the heat losses in the part of the system between the point of aluminium and gas production and the low temperature zone can be sufficiently restricted it may be unnecessary to introduce any additional energy into the slag stream during flow through this part of the system since it already has sufficient sensible heat. In almost all instances where electrical resistance heating is employed there will be generation of heat in this part of the system, and this can serve to increase the heat energy available to drive reaction (ii).

In the low temperature zone there will be a sharp drop in temperature at the point where carbon is introduced to the slag stream by reason of the endothermic heat of reaction of reaction (ii). Energy is required to raise the temperature of the slag as it is progressed from this point to the high temperature zone and thus most or all of the requried energy is introduced into the slag during this progress and progress through the high temperature zone to the end of the region of Al and gas production. The major introduction of energy is conveniently achieved by passing electrical current through the slag. Most conveniently there is a continuous passage of current through the slag, with the physical configuration of the slag stream so arranged that the major release of heat energy is in the course of progress of the slag from the point of lowest temperature in the low temperature zone to the end of the region of Al and gas production.

In a preferred operation in accordance with the invention the cyclic movement of the molten slag between zones where reactions (ii) and (iii) take place, reaction (ii) enriching the slag in $Al_4C_3$ and reaction (iii)

depleting it with simultaneous release of metal, is achieved by utilising the bubbles generated in reaction (iii) as a gas lift pump. Preferably the zones for performing reactions (ii) and (iii) are physically separated but as a possible, but less desirable, alternative reactions (ii) and (iii) can be carried out in different regions of a single vessel, the electrically heated molten slag being circulated between these different regions by gas lift and/or thermal convection.

Figure 2:
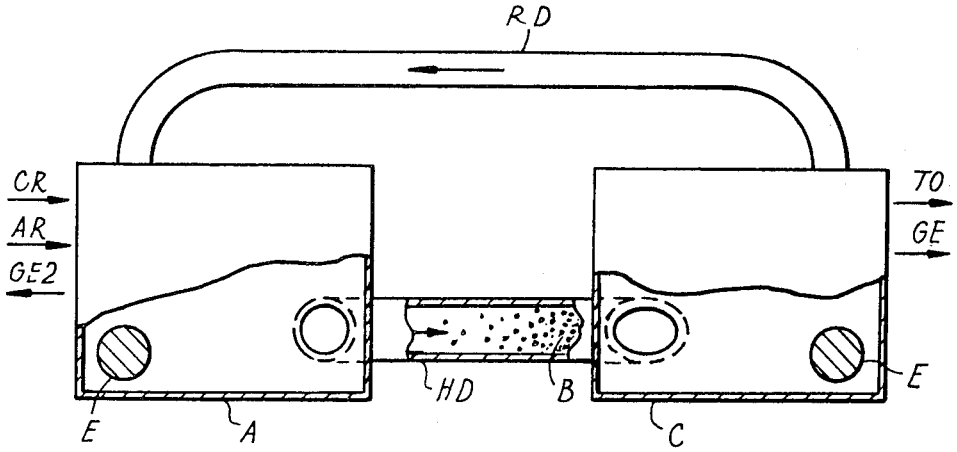
Figure 3:
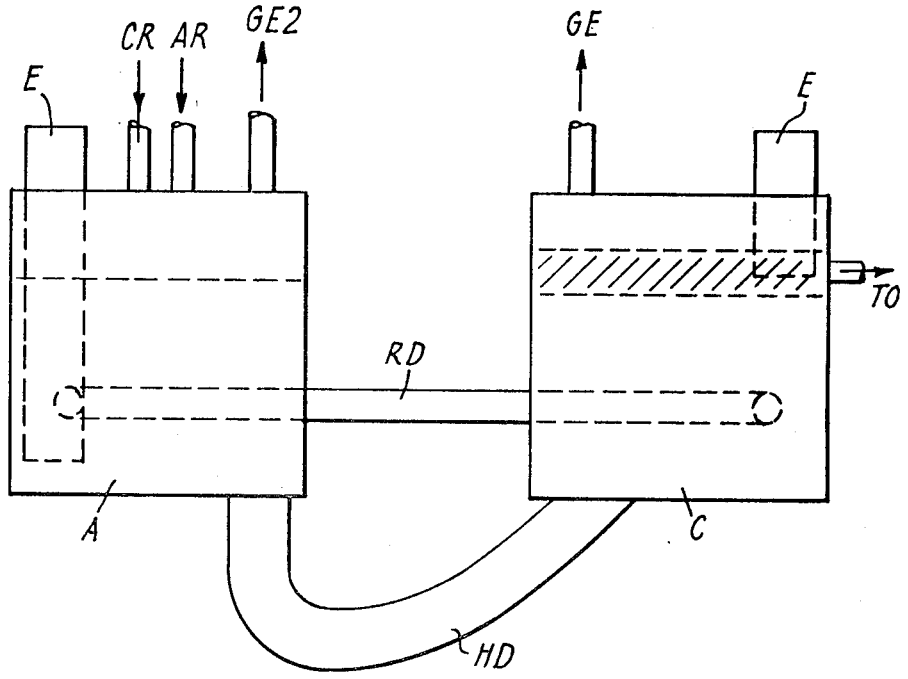
Figure 5:
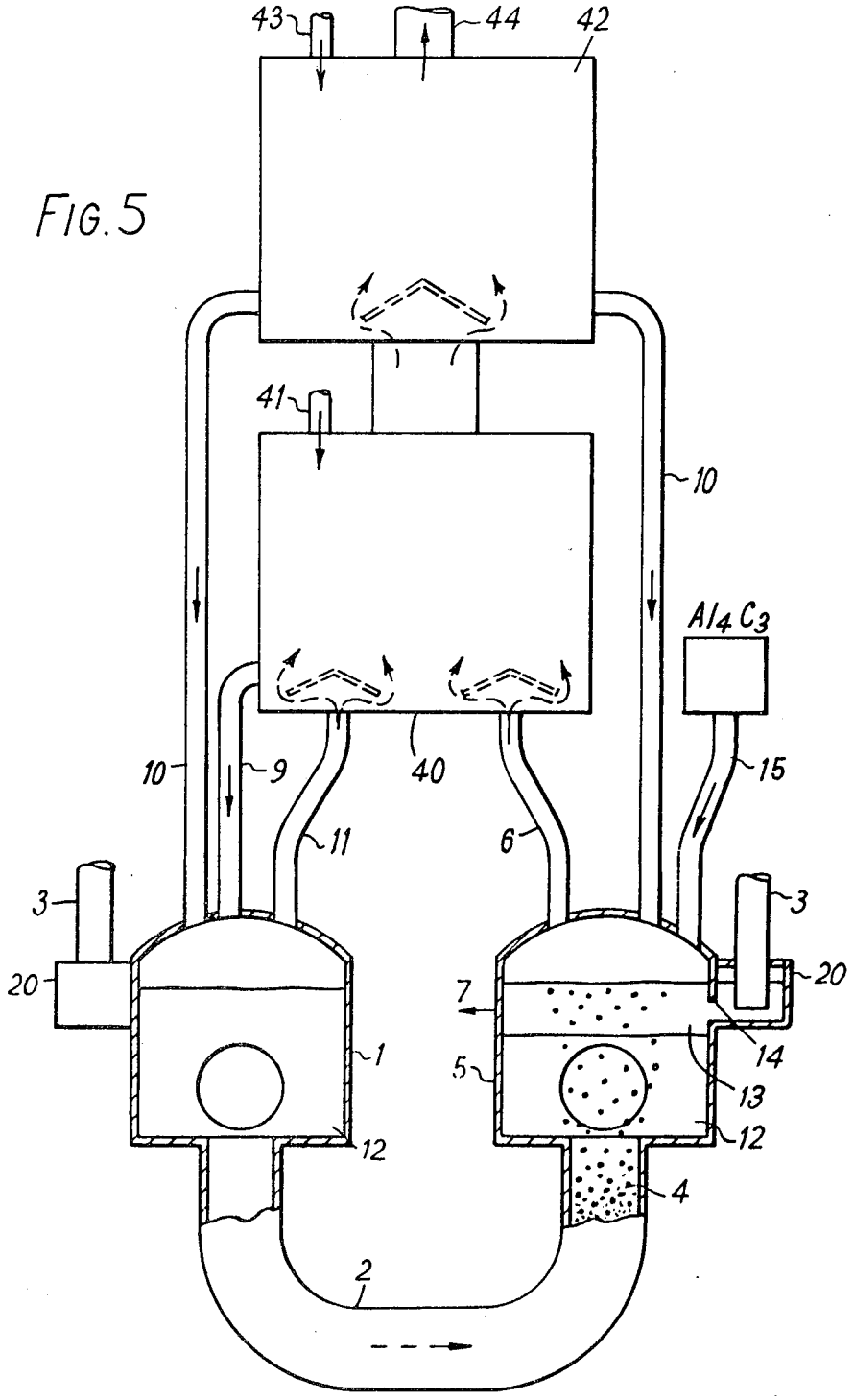
Figure 7:
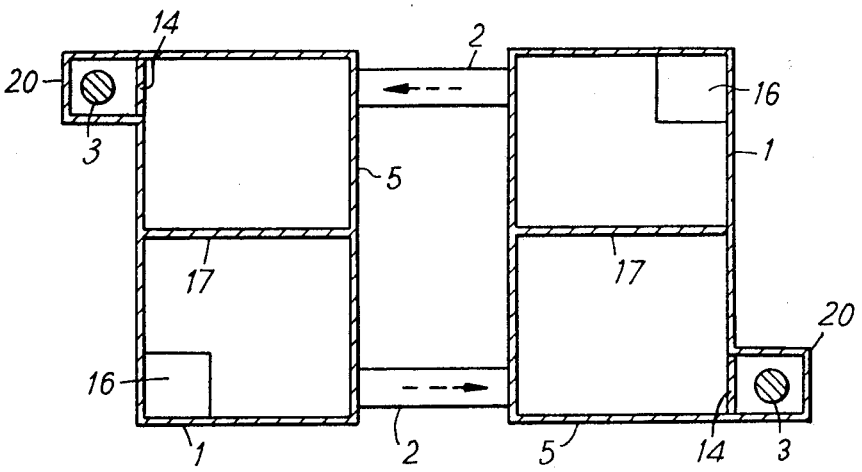
Figure 8:
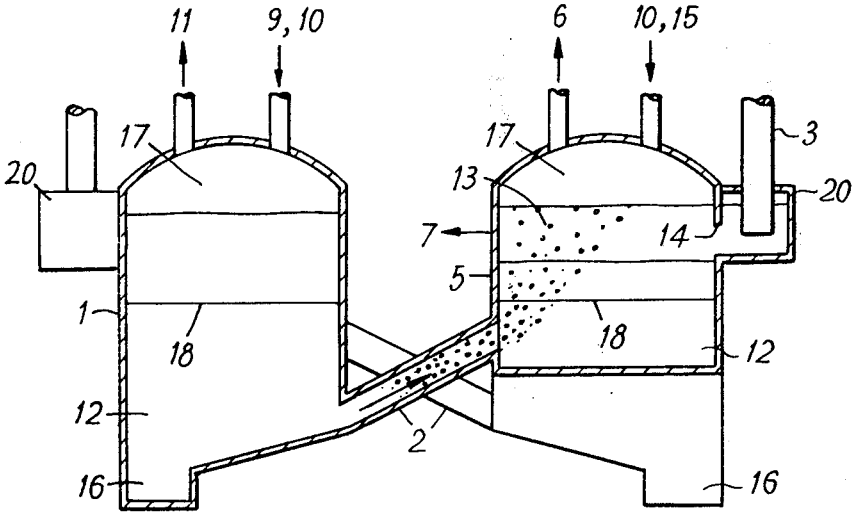
Figure 9:
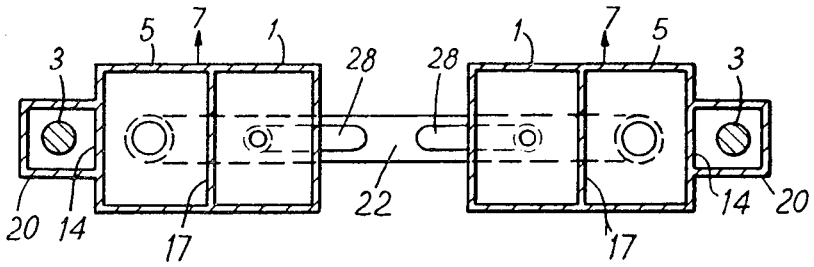
Figure 10:
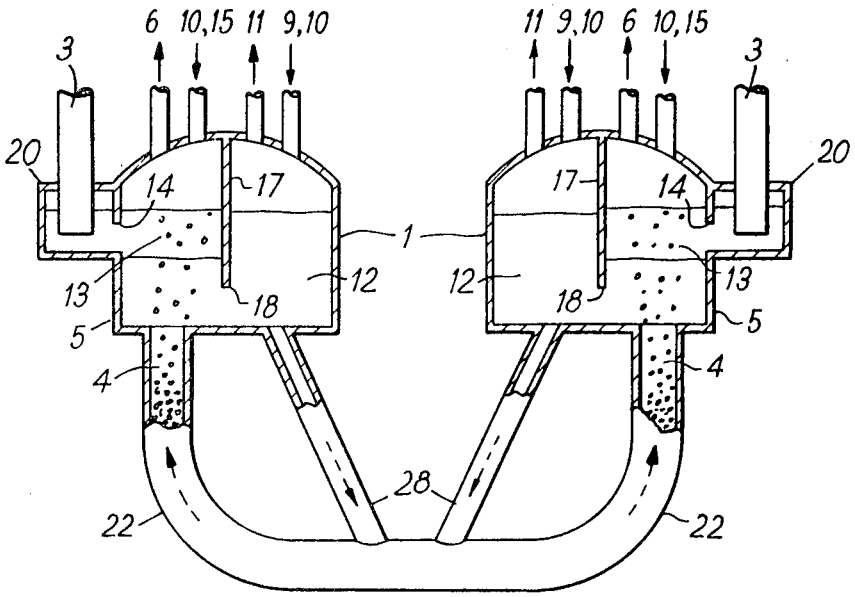
Figure 11:
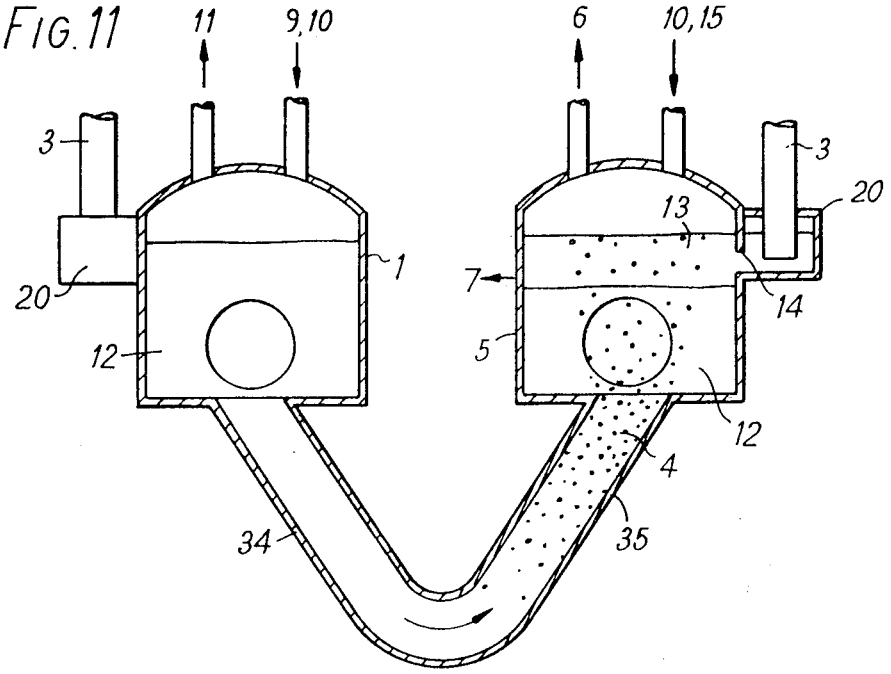
Figure 14:
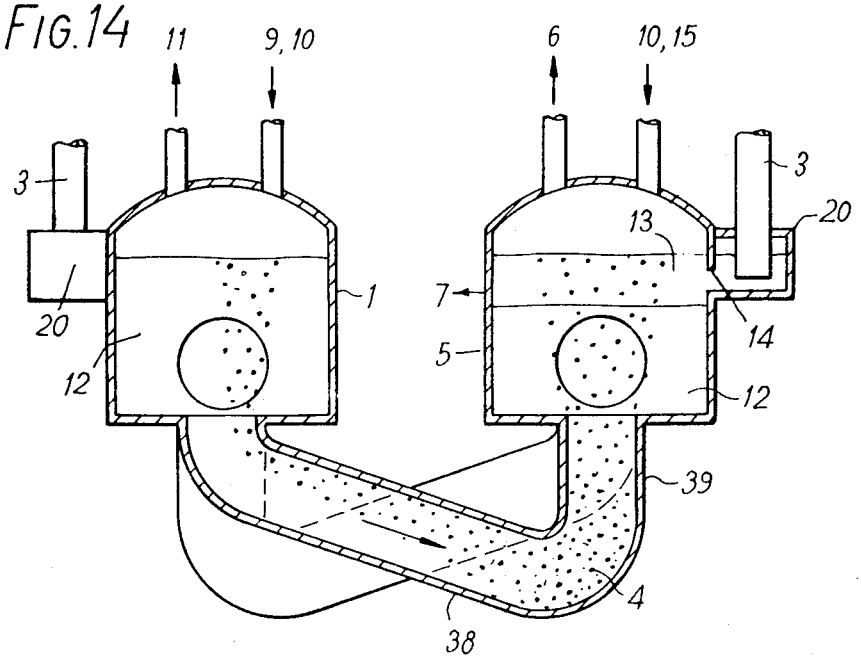
Figure 15:
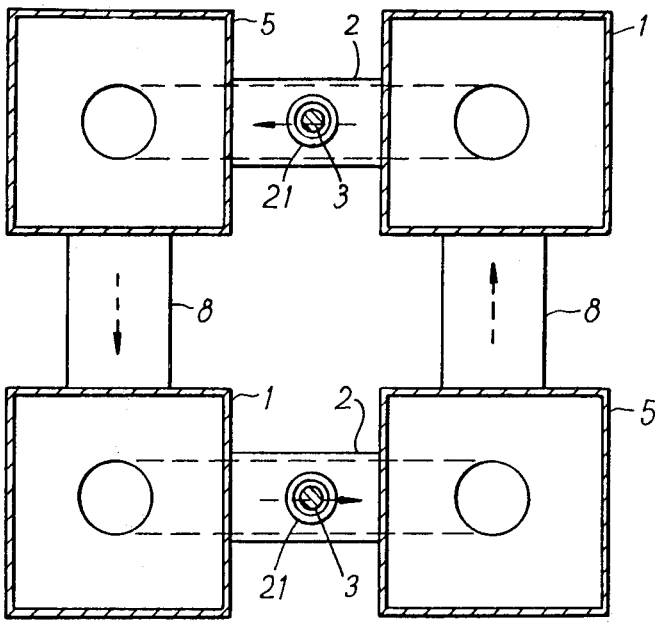
Figure 16:
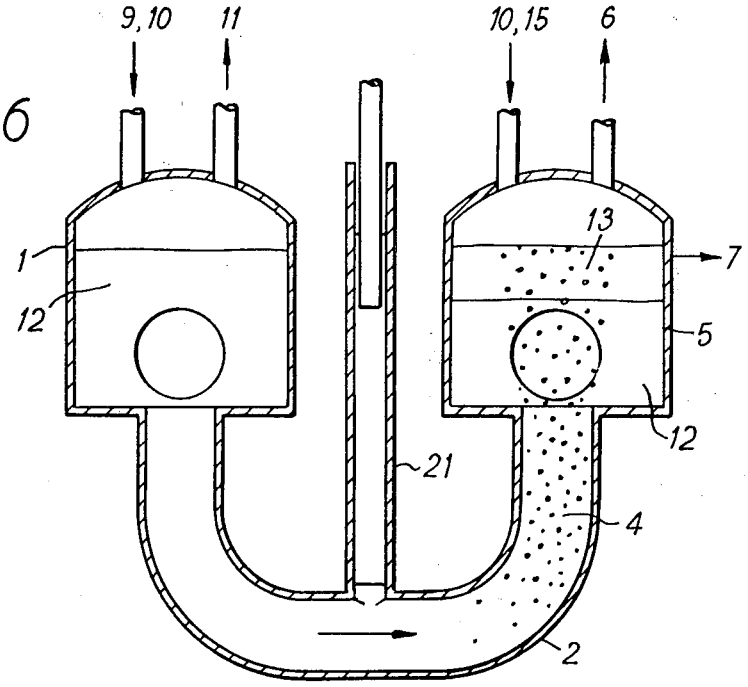
Figure 17:
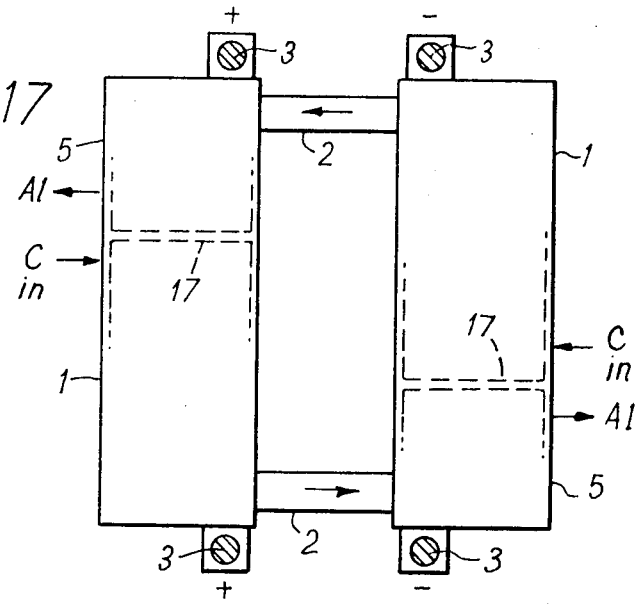
Figure 18:
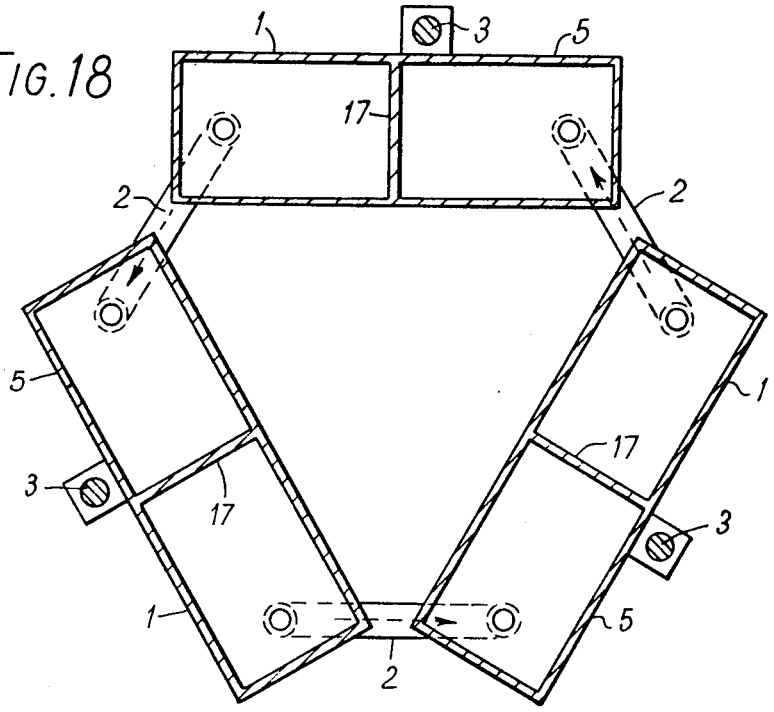
Figures 19A, 19B:
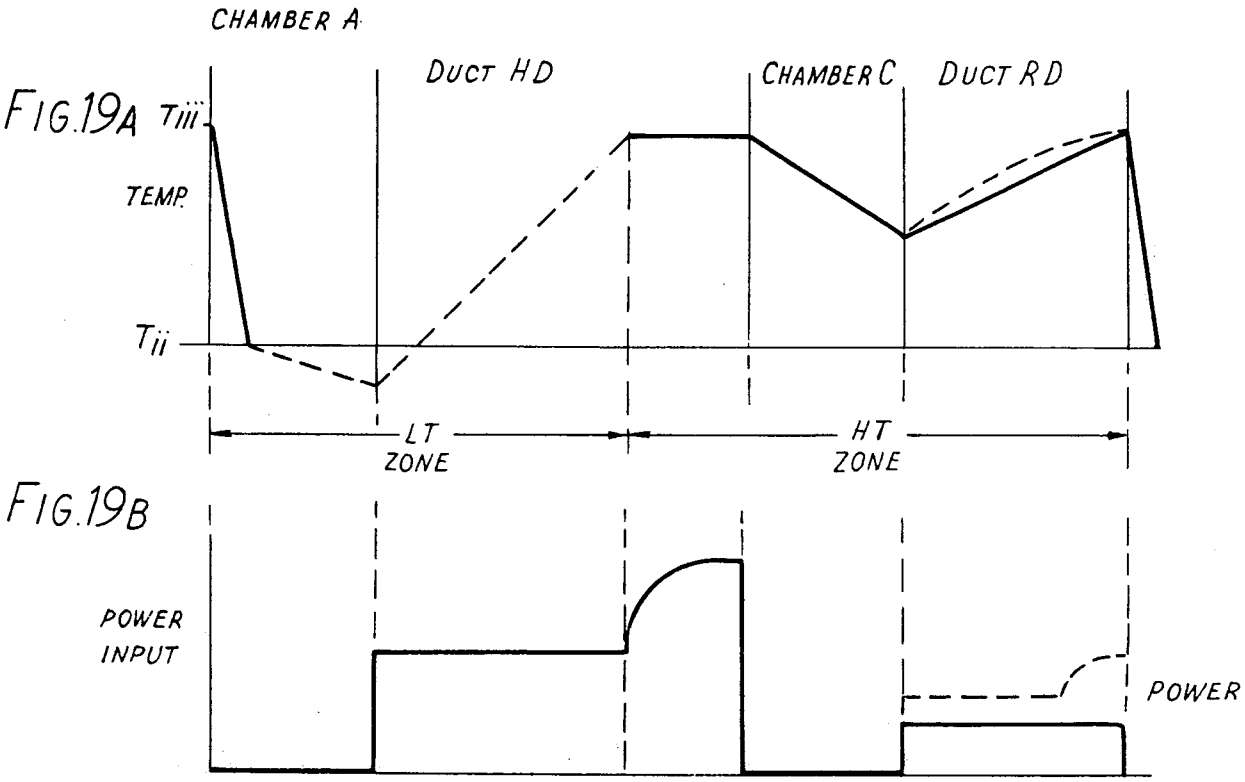

The invention is further described with reference to the accompanying drawings wherein:

FIG. 1 represents the operating cycle of a preferred method of carrying out the process of the present invention, FIGS. 2 and 3 are respectively a diagrammatic plan view and side view of a simple form of apparatus for carrying out the operating cycle of FIG. 1 and FIG. 4 is a diagrammatic view of a modified form of apparatus, FIG. 5 is a diagrammatic side view of the apparatus of FIG. 4 with associated gas scrubbers, FIG. 6 is a diagrammatic end view of the apparatus of FIG. 4, FIGS. 7 and 8 are repsectively a diagrammatic plan and diagrammatic side view of a modified form of the apparatus of FIGS. 4 to 6, FIGS. 9 and 10 are respectively a diagrammatic plan and side view of a further modified apparatus for performing the process of the invention, FIG. 11 is a side view of a further modified form of the apparatus of FIGS. 4 to 6, FIGS. 12 and 13 are respectively a plan and side view of a still further modified form of the apparatus of FIGS. 4 to 6, FIG. 14 is a side view of a still further modified form of the apparatus of FIGS. 4 to 6, FIGS. 15 and 16 are a plan and side view respectively of the apparatus of FIGS. 4 to 6 with a modified arrangement of the electrodes, FIG. 17 is a plan view of an apparatus with a further modified arrangement of electrodes, FIG. 18 is a plan view of an apparatus for operation with 3-phase alternating current and FIGS. 19A and 19B are respectively a temperature profile and an electrical power input profile of the system of FIGS. 2 and 3.

The principles of the process may be readily appreciated by reference to FIG. 1, in which the conditions of a typical operating cycle are superimposed on a phase diagram of the system $Al_2O_3$-$Al_4C_3$. The line ABCD indicates the boundary between the solid and liquid phases. The line EF indicates the conditions of temperature and composition required for reaction (ii) to proceed at 1 atmosphere pressure and the line GH indicates the conditions of temperature and composition necessary for reaction (iii) to proceed at 1 atmosphere pressure. It will be understood that the position of the lines EF and GH are displaced upwardly with increase of pressure.

Molten slag after separation from product Al and CO gas (at approximately 1 atm total pressure) has a temperature and composition corresponding to point U. On coming into contact with carbon feed in the low temperature reaction (ii) zone, reaction (ii) takes place, enriching the slag in $Al_4C_3$ and lowering its temperature (since the reaction is endothermic) until point V is reached. The enriched slag, from the low temperature reaction (ii) is then heated. Reaction (iii) commences in the high temperature zone, releasing CO and Al when the reaction pressure of the liquid equals the local static pressure, at point X; thereafter continuing heat input and/or decrease of local static pressure (due to the liquid/gas mixture rising) causes reaction (iii) to proceed, the $Al_4C_3$ content of the slag dropping. In steady-state operation conditions return to point U. It is apparent that to achieve this result feed rate of raw materials, power input and circulation rate must be in balance. The operating cycle represented by the triangle UVX is idealised and the values of U and V indicated in FIG. 1 is only one possible combination of operating values.

It is desirable to operate with the value U as close as possible to the point H so as to hold the temperature of the evolved gas as low as possible and consequently to hold down the fume content. If an attempt is made, however, to select point V at a composition too rich in $Al_4C_3$, i.e. beyond point F, solid $Al_4C_3$ will precipitate out of the slag and this may be undesirable.

Although the alumina may be fed with the carbon to the reaction (ii) zone, this is not necessarily the case. Alumina can be fed to the region containing Al metal with possible advantageous decrease in the amount of $Al_4C_3$ dissolved in the metal. Since the alumina is more dense it will pass through any supernatant molten metal layer into the molten slag. If the alumina feed is not fully preheated, heat is preferably generated in the slag during its return to the reaction (ii) zone to make up the resulting temperature drop.

To facilitate comprehension of the practical application of the process, the salient features of the cyclic operation are schematically indicated in FIGS. 2 and 3. Molten slag leaving the reaction (ii) zone (A) at a temperature in the range of for example 1950°-2050° C. has been enriched in $Al_4C_3$, and enters a generally U-shaped heating duct (HD) in which it is subjected to resistance heating by electrical current flowing between the two electrodes (E). As the liquid proceeds along the duct (HD) its temperature rises until the point where reaction (iii) (about 2050°-2150° C. according to slag composition and local pressure) can commence. At this point the slag may be considered as entering the high temperature zone already referred to. From there on in its passage to product collection zone (C) the energy supplied goes to drive reaction (iii), gas bubbles and metal droplets (B) being produced. The duct in this region should be vertical or sloping upwards in the direction of flow to enable the rising bubbles to act as a pump. In the product collection zone (C) gas is removed at gas exit (GE) and liquid Al collects on top of the molten slag and can be removed at tap off point (TO). The liquid Al has a large content of dissolved $Al_4C_3$. However techniques for freeing liquid Al from $Al_4C_3$ are known and form no part of the present invention. The region in which reaction (iii) takes place is thus principally constituted by the rising portion of the heating duct (HD) although some further reaction may occur in product collection zone (C) as the static pressure of the rising slag continues to fall. The slag, which has been depleted in $Al_4C_3$ but is substantially at the temperature of point U in FIG. 1, enters the return duct (RD) which, since it is electrically in parallel with the heating duct (HD), is sized to have a higher electrical resistance than the heating duct (HD) so that it takes less current. On reaching the low temperature reaction (ii) zone (A) where carbon reactant (CR) and alumina reactant (AR) are fed, the slag reacts with them because its temperature is above that for equilibrium; the enthalpy of the endothermic reaction is supplied by cooling the liquid. The gas of reaction (ii) is generated in zone (A) and led off at a second gas exit (GE2).

Aluminium carbide, subsequently separated from the metal tapped off as product, is added back to the system preferably at the product collection zone (C), since it inevitably contains metal which should be recovered.

Although in general it will prove advantageous to build equipment in which reactions (ii) and (iii) are carried out separately, there may be cases where the simplicity of equipment for carrying them out together in a single vessel outweighs the disadvantages. In that case the slag can still be heated resistively, and it can still be circulated, either by gas lift or, if the static pressure is too high to permit bubble generatic by thermally induced convection. The resistive heating can, for example, be achieved by passage of current between vertically spaced electrodes immersed in the slag.

The introduction of energy by resistive heating has very important advantages from the electrical point of view. Because the liquid resistor, formed by a body of molten slag, can be designed to have a fairly high electrical resistance it operates at a higher voltage and lower current (either AC or DC) than an arc furnace of comparable power input; there is no problem with low power factors; and the heat is generated in the slag where it is needed so that there is no heat transfer problem and heat losses are reduced. Overheating in the reaction zones is avoided with beneficial effects in reducing the fume generation as compared with the already mentioned arc process. At the same time the electrodes can operate under much more favourable conditions; they are carrying a lower current and can be placed in a much less aggressive environment. If they are placed in the zones where reaction (ii) is taking place the temperature is relatively low, the gas contains only small amounts of aggressive compounds, a local excess of carbon may be maintained by feeding carbon around the electrodes and so that there is little tendency for the electrodes themselves to be attacked. If, on the other hand, they are placed in the regions where product Al metal is collecting they may be kept in a comparativel cool area at the side with electrical connection to the slag being made via molten Al metal. In the scheme of FIGS. 2 and 3 both these electrode locations are utilised for electrodes E.

Despite the alleviation, already referred to, of the fume problem by the process of the present invention, some problem still remains. Previous attempts (e.g. Canadian Pat. No. 798,927) to reduce fume loss by contacting the evolved CO wit the incoming carbon and alumina charge in a carbothermic reductic process have run into difficulties because partial melting of the aluminium oxycarbide thereby formed by reaction with carbon and $Al_2O_3$ makes the charge sticky. It is therefore proposed, according to a preferred method, to contact the carbon and the alumina separately with the gas; $Al_4C_3$ formed by reaction between carbon and vaporised Al is solid at the temperature concerned and not sticky. The gas is thus contacted first with the carbon which removes aluminium suboxide and Al metal vapour from the gas. The thus cleansed gas is then employed to contact and preheat the alumina feed material. By keeping the carbon and alumina components separate it is also feasible to feed these two reactants to different parts of the system, as described above.

For maximum heat economy the carbon feed may be composed of uncalcined coke or coal particles and the alumina feed may be hydrated alumina, so that the sensible heat of the carbon monoxide may be employed to calcine these materials. For this purpose some of the CO may be burned if necessary.

The reaction (ii) zone is preferably provided with a sump to permit any components more dense than the molten slag to be collected and tapped off from the system. This allows at least a part of any metallic impurities (such as Fe or Si) introduced in the charge to be removed in the form of an Fe-Si-Al alloy. Indeed, it may be necessary to add iron or iron compounds to ensure that the alloy so formed is dense enough to sink.

In FIGS. 4 to 6 a stream of molten slag 12 is circulated through an apparatus which comprises materials addition chambers (reaction (ii) zones) 1, product collection chambers 5, U-shaped resistance heating conduits 2, the outlet ends 4 of which serve as parts of the high temperature reaction (iii) zone and return conduits 8, which form the terminal portion of the high temperature zones and which, since they are electrically in series with the heating conduits 2, are of larger section and/or shorter length than said heating conduits. The return conduits 8 therefore have relatively low electrical resistance when filled with the circulating strea of molten slag 12, and heat generation is reduced. The inlet ends of the conduits 8 are positioned below the lower limit of the Al metal 13 floating on top of the molten slag 12. Electrodes 3 are provided in side wells 20 at the collection chambers 5, where they are positioned to be in contact with the molten Al product 13. Separation walls 14 serve to permit the temperature of the metal 13 to be lower in sidewells 20, as well as preventing the gas evolved in reaction (iii) (which will pass through the product collection chamber 5) from reaching the electrodes 3, thus minimising attack on the electrodes by the Al and $Al_2O$ fume content of the gas. Chambers 1 and 5 are provided with gas exit conduits 6, 11 to lead away the huge volumes of evolved carbon monoxide. It will be understood that the boundary between the low temperature zones and the high temperature zones lie at the points in conduits 2 where reaction (iii) commences and where conduits 8 enter chambers 1.

Gas exhausted via the exhaust gas conduits 6 and 11 is led into a first gas scrubber 40 where it passes through granular carbon material. Fresh carbon material, which may be constituted by coal or "green" coke, is supplied to the scrubber 40 via inlet 41 and is progressed through the scrubber countercurrent to the gas stream. Carbon, enriched with aluminium carbide and other aluminium-bearing components condensed from the gas, is supplied to the materials addition chambers 1 via supply conduits 9.

After passage through the first scrubber 40 the gas, still at very high temperature, enters a second scrubber 42 containing alumina, for the purpose of preheating the alumina feed to the system. Alumina from the bed of alumina in the scrubber 42 is led to the chambers 1 and/or 5 via supply conduits 10. Fresh alumina, which may be in the form of alumina trihydrate, is supplied to the scrubber 42 via inlet 43 and is progressed through the scrubber countercurrent to the gas stream, which is led away via outlet conduit 44. The gas then passes via heat exchangers to a gas holder or to gas-burning apparatus for recovery of the heat energy of and for combustion of the carbon monoxide and volatiles (if any) from the carbon feed material.

Aluminium carbide, recovered from the product aluminium, is recycled to the collection chambers 5 from a storage via conduit 15.

In all Figures except FIG. 5 the conduits 9 and 10 leading to chambers 1 and the conduits 10 and 15 leading to chambers 5 are, for simplicity, shown as a single conduit.

As already explained, energy is introduced into the system by passage of electric current through the molten slag 12 through the current paths extending between the electrodes 3.

The containment of the molten slag is effected by forming a lining of frozen slag within a steel shell as is common practice in the fused alumina abrasive industry where it is well known to use water-cooled steel shells for that purpose. Nonetheless, in order to ensure the safety of the system and to avoid the possibility of breakthrough of molten slag, it is prudent to provide features such as:

1. Two duplicate and completely independent water cooling systems, consisting of sprays impinging on the steel shell, either of these systems being more than adequate for the maintenance of the necessary lining of frozen slag, and only one at a time being normally in use.
2. Infra-red radiation detectors or other temperature sensors which monitor the steel shell. If the shell temperature exceeds a first preset limit, the second cooling system is brought automatically into operation. If, after an appropriate interval of time, the temperature is still above said first limit, or if it rises above it at any time when both cooling systems are in operation, power to the system is automatically interrupted. If also, at any time, temperature exceeds a second higher preset limit, power is automatically interrupted.
3. A current detector in the electrical grounding connection to the steel shell. Should an electrical path develop between any of the electrodes and the shell, power is automatically turned off and the duplicate water cooling system turned on. In order to decide whether it is safe to put the power back on again, another system would be provided for determining the electrical resistance between each of the electrodes and the shell.

These features are not illustrated in FIGS. 4 to 6.

The basic apparatus is capable of numerous modifications which may be found to be of operational advantage, as shown in FIGS. 7 to 18.

FIGS. 7 and 8 show a system in which the resistance heating conduits 2 consist of simple upwardly sloping tubes leading from the lowermost portion of the chambers 1 to the chambers 5. Chambers 1 include sumps 16 to allow removal of metallic impurities such as Fe or Si which may enter with the charge materials (carbon or alumina) either in the metallic state or as reducible compounds. In this system, a separating wall 17, whose lower edge 18 extends below the level of the aluminium metal 13, is used to allow the return of the slag from the separation chamber 5 to materials addition chamber 1 (which constitutes the reaction (ii) zone), while preventing passage of metal 13. In FIGS. 7 and 8 the boundary between the low temperature zone and the high temperature zone may be at any position along the upwardly sloping conduits 2, according to the selected operating conditions.

A modification of this arrangement is shown in FIGS. 9 and 10 where the two straight sloped heating conduits of FIG. 8 have been replaced by a single U-shaped heating duct 22 and two smaller return ducts 28 which recycle the slag from the material additions chamber 1 to the bottom of the heating duct 22 and provide paths of high electrical resistance in relation to the corresponding parts of the duct 22. In FIGS. 9 and 10 the boundary between the low temperature zone and the high temperature zone lies in the duct 22 between the lower ends of the return ducts 28 and the upper ends of the duct 22.

In the alternative form of the apparatus shown in FIG. 11 the resistance heating conduit may consist of two legs 34, 35 inclined to provide a substantially V-shaped conduit in place of a vertical leg forming the lower portion of the reaction (ii) zone and an upwardly inclined leg leading up into the separation zone, as in FIGS. 7 and 8. In another alternative (FIGS. 12 and 13) a recycle leg 37 of smaller diameter may be provided in parallel with the upward leg of the resistance heating conduit 2 to recycle part of the slag from chamber 5 to the bottom of the conduit and provide a more bubble-free current path. This may be advantageous for the electrical stability of the system.

In a yet further alternative (FIG. 14), the down-leg 38 of the resistance heating conduits may be sloping and the up-leg 39 be vertical. In such cases, depending on the relative rates of heating and increase in pressure as the slag flows through the conduit, gas evolution from reaction (iii) may commence before the bottom of the conduit is reached. In other words, the boundary between the low temperature zone and the high temperature zone is located in the leg 38 towards its lower end. Since the gas returning up the gently sloping down-leg 38 will have much less pumping action than the gas in the vertical up-leg, the pumping action in the desired direction towards chamber 5 will be maintained, and gas evolved in reaction (iii) before the slag reaches the bottom of the conduit will be countercurrently scrubbed by the relatively cool descending slag in the leg 38. It will thus be discharged in a fume-reduced state through reaction (ii) zone chamber 1.

In another modification shown in FIGS. 15 and 16 the electrodes 3 may be electrically connected with the slag at the bottom of U-tube resistance heating conduits 2 in place of or in addition to either of the locality of the reaction (ii) chamber 1 or the product collection chamber 5. This may be achieved by immersing each electrode 3 in a column of molten aluminium in a standpipe 31 opening upwardly from the bottom of the resistance heating conduit 2. In this case the high temperature zone commences to the right of standpipe 21 to avoid difficulty with evolved gas entering it.

A further possible modification of the arrangement of the electrodes is shown in FIG. 17, which is a plan view of a modified form of the apparatus of FIGS. 7 and 8 and employs four electrodes 3 electrically connected so as to confine the heating currents to the passages 2 thus avoiding heating the slag as it flows from the collection chambers to the material additions chambers. Similar modifications can be made in other forms of apparatus illustrated in the Figures.

The system described with relation to the above-described Figures can be operated using either AC or DC power. Although use of AC is in general cheaper than use of DC, large units employing single phase AC would be undesirable because they would cause imbalance in electrical distribution systems. FIG. 18 shows how the invention can be adapted to use 3-phase AC power, thus allowing operation of large units on AC at relatively high voltage and low current with attendant economic advantages.

Examples of FIGS. 4 to 18 merely illustrate some of the many possible arrangements for carrying out this invention; combinations of the features shown as well as other geometries employing the principles described are obviously covered by the present invention.

It will be understood that the gas scrubbing arrangement of FIG. 5 may be employed with the modified apparatus of FIGS. 2, 3, and 7 to 18.

Many different means for initially establishing a body of molten alumina in the apparatus may be envisaged. The simplest and most convenient is achieved by initially filling the apparatus with thermit ($Al+Fe_2O_3$) and igniting the same. The molten alumina is thereafter maintained in molten condition by passage of electric current.

FIG. 19A shows schematically the variation of temperature around the system of FIGS. 2 and 3. Commencing with liquid slag at reaction (iii) temperature T(iii) entering chamber A, the temperature drops rapidly when the liquid contacts the carbon feed due to the endothermic reaction (ii) until the temperature reaches the equilibrium temperature T(ii). If there are significant heat losses from chamber A the liquid temperature will continue to fall until it enters the heating duct (HD). In the heating duct electrical energy input commences, as shown in FIG. 19B, and the temperature rises until T(iii) is again reached. Continued energy input does not lead to further temperature rise but to reaction (iii); the gas formed raises the electrical resistance of the slag and the rate of energy input increases. In chamber C temperature again decreases due to heat losses. In the return duct (RD) electrical energy again raises the temperature, which may or may not reach T(iii); if reaction (iii) commences again the increased resistance of the gas bubbles once more raises the rate of power input. In FIGS. 19A and 19B the solid line in the section relating to Duct RD illustrates the case where the temperature does not reach T(iii). The dotted line illustrates the case where the temperature reaches T(iii) at some point in Duct RD.

We claim:

1. Apparatus for the production of aluminium metal by the direct reduction of alumina by carbon comprising four sequentially arranged chambers adapted to receive and contain a body of molten slag composed of alumina and combined carbon in the form of at least one of aluminium carbide and aluminium oxycarbide, means for supplying carbon feed material to the first and third chambers, flow conduits for said slag from said first and third chambers to said second and fourth chambers respectively, each of said flow conduits having an upwardly directed outlet end portion, return conduits for said slag respectively leading from a lower region in each of said second and fourth chambers to said third chamber and said first chamber respectively, said return conduits, when filled with molten slag, constituting relatively lower electrical resistance paths than said flow conduits, means for supplying alumina feed to at least one of said chambers, spaced electrode means arranged to contact said slag for passage of electric current through said slag, means for discharging gas from each of said four chambers and means for collecting and discharging Al metal from said second and fourth chambers, said electrode means being arranged so that the electric current flows in each flow conduit in series with a return conduit.

2. Apparatus according to claim 1 in which said electrode means are arranged in said second and fourth chambers.

3. Apparatus according to claim 1 in which said electrode means are arranged in a position to be above the lower limit of a supernatant layer of product aluminium metal supported on said slag in said second and fourth chambers, said electrode means being in direct electrical contact with said layer of product metal.

4. Apparatus according to claim 3 in which said electrode means are arranged in contact with molten aluminium in side wells in said second and fourth chambers, partition means screening said electrodes from gases evolved in said second and fourth chambers.

5. Apparatus according to claim 2 further including additional return flow conduits of relatively small diameter for said slag, leading from a lower region in said second and fourth chambers downwardly into the flow conduits from said first and third chambers respectively.

6. Apparatus for the production of aluminium metal by the direct reduction of alumina by carbon comprising a first chamber for holding a molten body of a slag composed of alumina and combined carbon in the form of at least one of aluminium carbide and aluminium oxycarbide, means for introducing carbon feed material into said first chamber, a second chamber for holding a molten body of said slag, means for supplying alumina feed material to at least one of said chambers, means for discharging gas from said first chamber and from said second chamber, flow conduit means from said first chamber to said second chamber, at least part of said flow conduit being upwardly inclined towards said second chamber, at least one electrode arranged in each of said chambers for passage of electric current through said slag in said flow conduit to supply heat energy thereto, a return conduit from said second chamber to said first chamber, constituting a path of higher electrical resistance than said flow conduit when filled with said molten slag and means for collecting and discharging aluminium metal from said second chamber.

7. In apparatus for the production of aluminum metal by reduction of alumina with carbon in a molten slag that comprises alumina and combined carbon, in combination:

a. molten-slag-containing structure including at least one pair of enclosed chambers for holding bodies of such slag, each such chamber having means for exhausting gas therefrom, and b. a first chamber of said pair having passage means to receive a a stream of slag;

c. means for introducing carbon feed material into the molten slag in said first chamber;

d. flow conduit means connecting said first chamber with the second chamber of said pair for forwarding a stream of slag from the first chamber to the second, said flow conduit means having at least its terminal portion disposed in an upward direction, and e. said second chamber being arranged to collect product aluminum therein and having passage means to discharge a stream of molten slag therefrom;

f. means for introducing alumina feed material into the slag in said structure; and g. electrical-current-producing means for establishing a flow of current in the slag in said structure, including said flow conduit means, to generate heat in said flow conduit means, whereby gas generated from reaction in the slag caused by said heat is effective in said terminal portion of said flow conduit means to propel the slag along the flow conduit means and into said second chamber, said electrical-current-producing means, and the structure consisting of said flow conduit means, said chambers and passage means, being mutually constructed and arranged so that the major release of heat energy by said current flow through the slag in said last-mentioned structure occurs in said flow conduit means.

8. Apparatus as defined in claim 7, which includes:

h. a first vessel arranged to receive and contain carbon feed material and connected to be comprised in the aforesaid means for introducing carbon feed material in the slag in the first chamber, said means for exhausting gas from one of said first and second chambers being arranged to direct such gas through the said vessel, and i. a second vessel arranged to receive and contain alumina feed material and connected to be comprised in the aforesaid means for introducing alumina feed material into the slag in said structure, said first vessel having means for exhausting gas from it into and through the second vessel, j. said vessels being constructed and arranged so that the gas from said one of the chambers passes first in heat exchange and scrubbing relation with the carbon feed material in the first vessel, and thereafter separately in heat exchange relation with the alumina feed material in the second vessel.

9. Apparatus as defined in claim 8, in which the means for exhausting gas from both the first and second chambers are arranged to direct such last-mentioned gas through said first vessel, said vessels being thereby constructed and arranged so that gas from both the first and second chambers passes through the vessels in succession.

10. Apparatus as defined in claim 7, in which said electrical-current-producing means comprises current-supplying electrodes respectively disposed for current-conducting connection with the molten slag at separate localities of said slag-containing structure that are spaced so that electrical current flows through the slag in said flow conduit means, between one electrode and another electrode.

11. Apparatus as defined in claim 7, in which said flow conduit means consists of a conduit extending along a straight, upwardly sloping path from the first chamber to the second.

12. Apparatus for the production of aluminum metal by reduction of alumina with carbon in a molten slag that comprises alumina and combined carbon, comprising:

a. molten-slag-containing structure including a plurality of interconnected enclosed chambers, each for holding a molten body of slag and each having means for exhausting gas therefrom, said chambers including b. one or more material-addition chambers arranged to receive a flow of molten slag;

c. means for introducing carbon feed material into the slag contained in said material-addition chamber or chambers;

d. said plurality of chambers also including one or more product-collection chambers arranged to collect product aluminum therein and to discharge a stream of molten slag thereform;

e. means for introducing alumina feed material into the slag in said structure;

f. one or more flow conduit means each connecting a material-addition chamber with a product-collection chamber for forwarding a stream of slag into the so-connected product-collection chamber, each said flow conduit means having at least its terminal portion disposed in an upward direction, and g. each product-collection chamber having also a separate connection to a material-addition chamber for passage thereto of a stream of slag from the said last-mentioned product-collection chamber; and h. means for introducing heat into the slag in the molten-slag-containing structure, said last-mentioned means and said structure being mutually constructed and arranged so that the major introduction of heat energy occurs in said flow conduit means to effect gas-generating reaction in the slag therein, whereby the generated gas is effective in said terminal portion of said flow conduit means to propel the slag along the flow conduit means and into the connected product-collection chamber.

13. Apparatus as defined in claim 12 which includes:

i. at least two material-addition chambers and at least two product-collection chambers, said plurality of chambers being arranged and interconnected in a continuous, molten slag circuit of alternating succession of material-addition and product-collection chambers, j. said apparatus further including: a plurality of flow conduit means, as defined, respectively connecting each material-addition chamber with the succeeding product-collection chamber and each having the aforesaid upward-direction disposition of its terminal portion, said heat-introducing means comprising means to introduce reaction-effecting heat in each said flow conduit means.

14. Apparatus as defined in claim 13, in which said means to introduce reaction-effecting heat in each said conduit means comprises electrical-current-producing means for establishing a heat-producing flow of current in the conduit means.

15. Apparatus as defined in claim 14, in which said electrical-current-producing means comprises a plurality of current-supplying electrodes respectively disposed for current-conducting connection with the molten slag in selected chambers so that electrical current flows through the slag in each said conduit means, between one electrode and another electrode, said molten-slag-containing structure, including said plurality of flow condiut means, and said current-supplying electrodes being mutually constructed and arranged so that the major release of heat energy by current flow through the slag occurs in said plurality of flow conduit means.

16. In apparatus for the production of aluminum metal by reduction of alumina with carbon in a molten slag that comprises alumina and combined carbon, in combination:

a. structure providing a system for circulation of molten slag, including at least one pair of enclosed chambers for holding bodies of such slag, each such chamber having means for exhausting gas therefrom, and b. a first chamber of said pair being arranged to receive a stream of slag;

c. means receiving carbon feed material and communicating with the structure, for supplying carbon into the molten slag in said first chamber;

d. flow conduit means connecting said first chamber with the second chamber of said pair for forwarding a stream of slag from the first chamber to the second, said flow conduit means having at least its terminal portion disposed in an upward direction whereby upon establishment of gas within the slag in said terminal portion, such gas is there effective to propel the slag along the flow conduit means and into said second chamber;

e. said second chamber being arranged to collect product aluminum therein and to discharge a stream of molten slag therefrom;

f. means receiving alumina feed material and communicating with the structure, for supplying alumina into the slag in the system;

g. a first vessel arranged to receive and contain carbon feed material and connected to be comprised in the aforesaid means for supplying carbon into the molten slag in the first chamber, said means for exhausting gas from the first and second chambers being arranged to direct such gas through the said vessel, and h. a second vessel arranged to receive and contain alumina feed material and connected to be comprised in the aforesaid means for supplying alumina into the slag in the system, said first vessel having means for exhausting gas from it into and through the second vessel, i. said vessels being constructed and arranged so that the gas from said first and second chambers passes first in heat exchange and scrubbing relation with the carbon feed material in the first vessel, and thereafter separately in heat exchange relation with the alumina feed material in the second vessel.

17. Apparatus as defined in claim 16, in which said flow conduit means is disposed for travel of slag therein only in a direction extending laterally and upwardly from the first chamber to the second, said first and second chambers and said conduit means being respectively shaped and mutually arranged to accommodate said conduit means disposed as aforesaid between the chambers.

18. Apparatus as defined in claim 17, in which said flow conduit means consists of a conduit extending along a straight, upwardly sloping path from the first chamber to the second.

* * * * *